US005322212A

United States Patent [19]

Strasevicz et al.

[11] Patent Number: 5,322,212

[45] Date of Patent: Jun. 21, 1994

[54] DISPLAY CONTAINER FOR VANITY TOPS AND THE LIKE

[75] Inventors: Steven A. Strasevicz, Yorba Linda; Robert Shoultz, Rancho Cucamonga, both of Calif.

[73] Assignee: Leucadia, Inc., New York, N.Y.

[21] Appl. No.: 995,181

[22] Filed: Dec. 22, 1992

[51] Int. Cl.[5] ..... B65D 5/20; B65D 85/00

[52] U.S. Cl. ..... 229/164; 206/320; 206/321; 229/117.16; 229/169; 229/174

[58] Field of Search ..... 229/117.16, 143, 147, 229/149, 164, 169, 174; 206/320, 321, 448, 591

[56] References Cited

U.S. PATENT DOCUMENTS

| | | | |
|---|---|---|---|
| 2,278,359 | 3/1942 | Nagle . | |
| 2,307,720 | 1/1943 | Ringler | 229/147 |
| 2,509,447 | 5/1950 | Prawdzik . | |
| 2,678,724 | 5/1954 | Andriot, Jr. . | |
| 2,779,463 | 1/1957 | Zimmerman . | |
| 2,998,909 | 9/1961 | Anderson, Jr. et al. | 229/169 |
| 3,034,697 | 5/1962 | Frankenstein | 229/169 |
| 3,038,513 | 6/1962 | Hamlett . | |
| 3,043,492 | 7/1962 | Stewart, Jr. . | |
| 3,099,351 | 7/1963 | Coffey, Jr. . | |
| 3,133,633 | 5/1964 | Redmond . | |
| 3,289,825 | 12/1966 | Smith . | |
| 3,363,749 | 1/1968 | Tinapple . | |
| 3,880,287 | 4/1975 | Loeffelman . | |
| 4,082,215 | 4/1978 | Eichenauer | 229/143 |
| 4,133,428 | 1/1979 | Glöyer . | |
| 4,349,147 | 9/1982 | Jensen | 229/143 |
| 4,418,863 | 12/1983 | Kimbrell, Sr. | 229/143 |
| 4,574,998 | 3/1986 | Vavra . | |
| 4,667,825 | 5/1987 | Durand | 229/164 |
| 4,671,413 | 6/1987 | Peterson . | |
| 4,715,493 | 12/1987 | Dreyfus . | |
| 4,759,446 | 7/1988 | Dobashi et al. . | |
| 4,807,746 | 2/1989 | Jacobs . | |
| 4,811,840 | 3/1989 | Muyskens . | |
| 4,860,948 | 8/1989 | Hofstede | 229/169 |
| 4,871,068 | 10/1989 | Dreyfus . | |
| 4,883,221 | 11/1989 | Brundage | 229/174 |

FOREIGN PATENT DOCUMENTS

| | | | |
|---|---|---|---|
| 394549 | 10/1990 | European Pat. Off. | 229/164 |

*Primary Examiner*—Gary E. Elkins

*Attorney, Agent, or Firm*—Robbins, Berliner & Carson

[57] ABSTRACT

A container for displaying and transporting a heavy product, such as a vanity top, that is fabricated and assembled as an integral unit to secure the product against possible damage while permitting the product to be easily transported and viewed by prospective purchasers. The container includes back, top, bottom and a pair of side wall panels. Each of the side wall panels has an elongated central flap section formed along an outer edge of the side wall panel which is hinged and folded inwardly to define a generally front-facing double fold front surface for the container slanted in a front and back direction and elongated in a direction generally transverse to the top and bottom wall panels for supporting a product in a slanted orientation opposite an elongated underside edge of the product. Additionally, each of the side wall panels has an upper end flap hinged along an upper edge of the side wall panel, the end flap is at least in part folded inwardly in spaced generally parallel relation to the side wall panel, defining a surface extending generally transverse to the top and bottom wall panels to block movement of the product toward the back panel.

23 Claims, 3 Drawing Sheets

FIG. 1
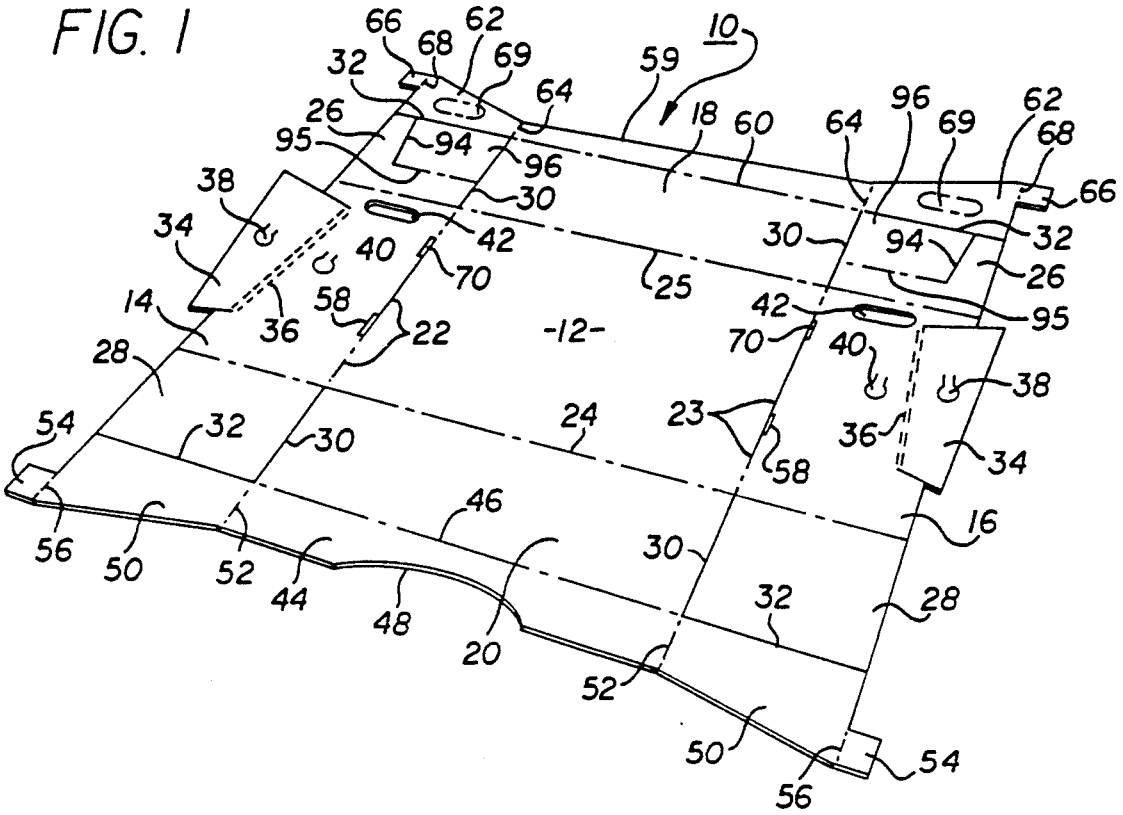
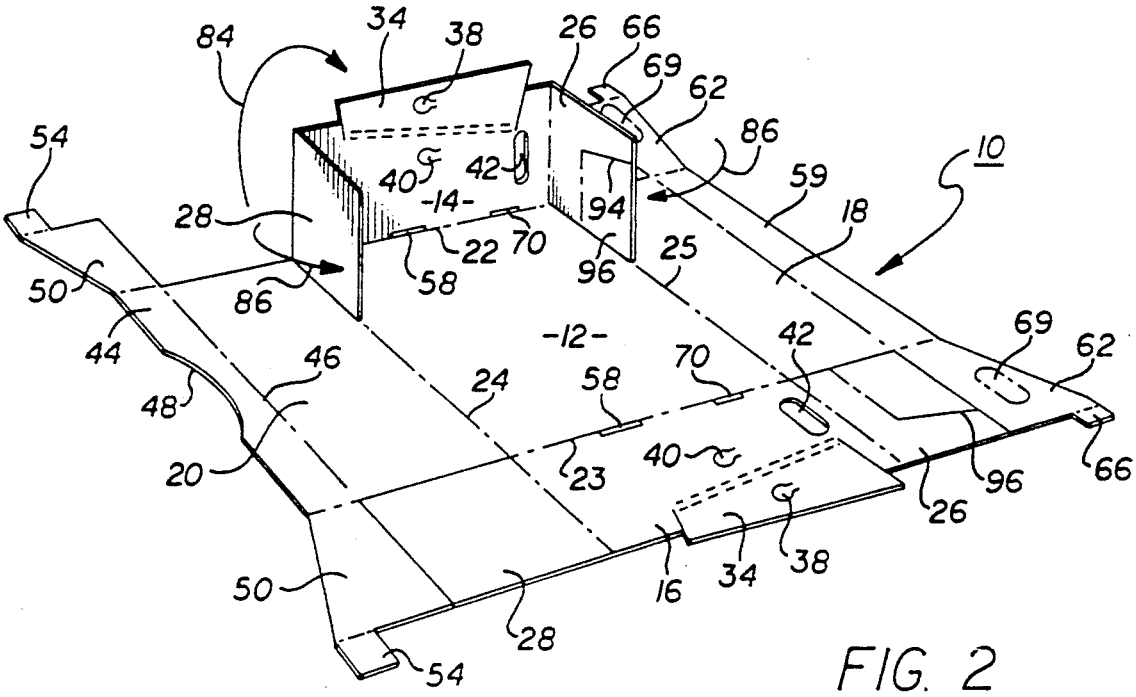
FIG. 2

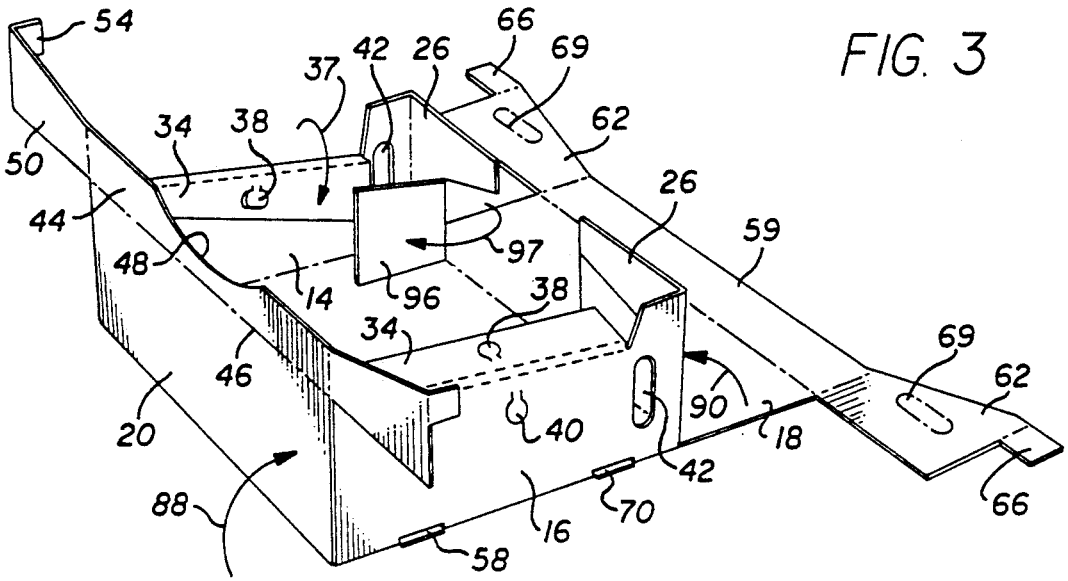
FIG. 3
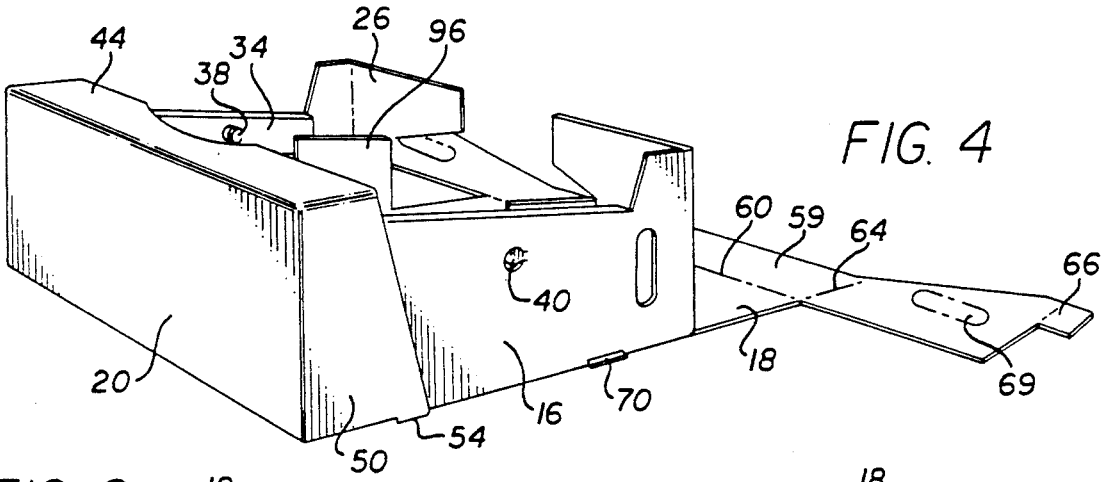
FIG. 4
FIG. 6
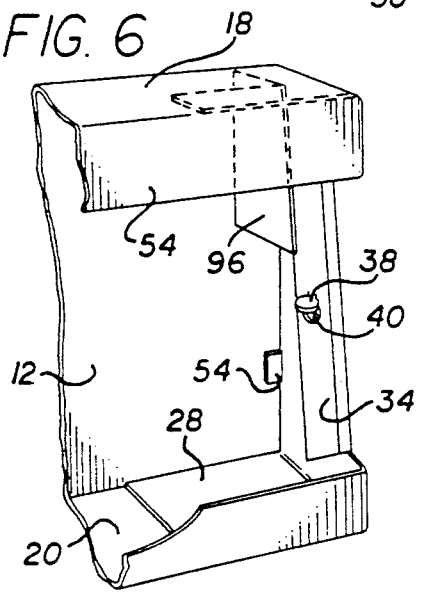
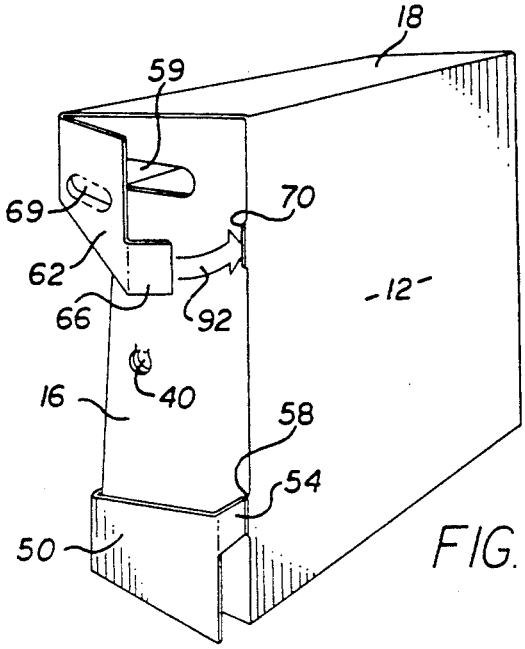
FIG. 5

FIG. 7
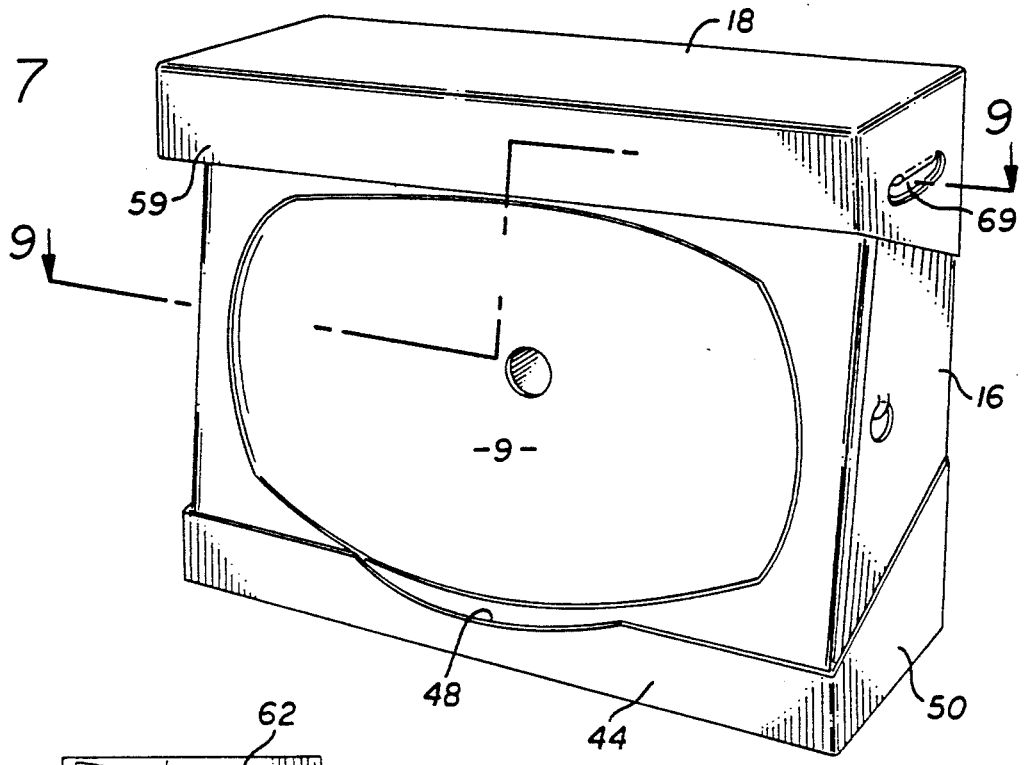
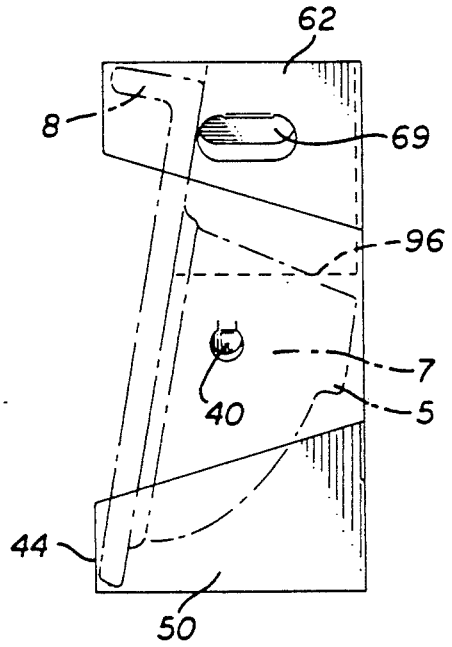
FIG. 8
FIG. 9
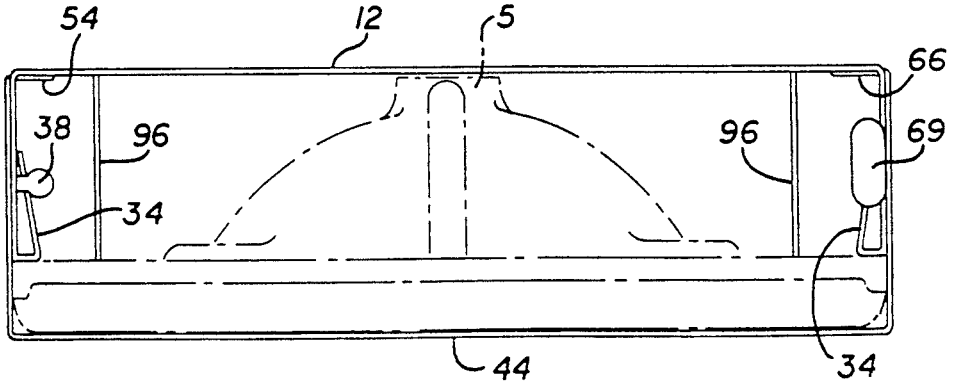

DISPLAY CONTAINER FOR VANITY TOPS AND THE LIKE

BACKGROUND OF THE INVENTION

The present invention relates to packaging, and more particularly to composite packaging for transporting and displaying vanity tops that have the bowl, surrounding top and splash panel formed as an integral unit using cultured marble materials or the like.

After being manufactured, vanity top assemblies and the like are commonly packaged for shipment from the factory to be distributed and sold to customers for installation. Frequently retailers and wholesalers want to display such products so that the color and surface texture can be viewed by the prospective buyers to insure that it matches their decorative needs. In the past, retailers and wholesalers often had to either cut openings in the container boxes so that the product could be viewed or actually remove one of the products from its shipping box display as a sample. However, cutting out a portion of the box entailed the risk of damaging or marring the smooth marble-like surface or of destroying the structural integrity of the container that the buyer used to transport his purchase. Also, the effort involved in cutting individual boxes or removing the product for display subjected the seller to unwanted labor expenses and inconvenience.

SUMMARY OF THE INVENTION

The present invention provides a container assembly for displaying and transporting vanity tops and the like that is fabricated and assembled as an integral unit to secure the product against possible damage while permitting the product to be easily transported and viewed by prospective purchasers.

In the preferred form of this invention, the container assembly is integrally formed from a single sheet of composite packaging material, preferably corrugated paperboard, cardboard or stiffened plastic sheeting. The sheet is cut and creased to define a rectangular back panel with hinged side, top and bottom wall panels that are interleaved and interlock to enclose the product within the container.

The top, bottom and side wall panels are secured together without glue or adhesive by means of strategically arranged flaps with interlocking tabs. Specifically, interlocking tabs are formed at the outer end of wedge-shaped flaps that extend outwardly on either side of the narrow front extensions on the top and bottom panels be to engaged in slots cut along the fold or crease lines where the side panels are hinged on either side to the back panel. By this means, the vanity top is frontally restrained at its top and bottom against the inner surface of the narrow front extensions while otherwise being exposed to view for display purposes.

In addition, both side panels are provided with overlapping intermediate flaps that fold inwardly to provide a double thickness for added structural rigidity in supporting and cushioning the undersurface of the vanity top along both side edges. Also, end flaps hinged at the top and bottom of the side panels fold inwardly to overlie the inner surface of the top and bottom panels to provide a double sheet thickness to cushion and support the back and front edges of the vanity top at the top and bottom of the container.

Specifically, the downwardly folded narrow top panel extension folds downwardly to cover and confine the splash panel at the back of the vanity top assembly, and narrow front extension on the bottom panel folds upwardly to cover and confine the front edge of the vanity top. Elongated oval shaped handle tabs cut into the wedge-shaped flaps at either end of the narrow front extensions on the top panel are hinged along their top edge to overlap and register with identical oval shaped handle openings cut near the top of both side panels whereby the oval tabs can be pushed inwardly to interlock with the side panel, thereby adding structural rigidity and providing sturdy handle openings for comfortably lifting and carrying the container.

With this box structure, almost the entire face of the vanity top or similar product, except for the narrow top and bottom portions covered by the narrow front extensions on the top and bottom panels, remains open to view for display purposes so that the color and texture of the product can be inspected by prospective purchasers without removing the product from or cutting into the container, while also being securely held and cushioned for convenient shipping and handling.

BRIEF DESCRIPTION OF THE DRAWINGS

FIG. 1 is a top perspective view showing a flat planar sheet of box material, such as cardboard, that is cut and creased to form a preferred embodiment of a vanity top container in accordance with the invention;

FIG. 2 is a side perspective view of the preferred embodiment of a vanity top container of FIG. 1 showing one of the side panels with its top and bottom flaps folded into position during assembly;

FIG. 3 is another side perspective view showing the vanity top container of FIGS. 1 and 2 partially assembled with both side panels having their top, bottom and center flaps folded into position and with the bottom panel folded inwardly;

FIG. 4 is a further bottom-side perspective view showing the vanity top container of FIGS. 1, 2 and 3 in a further stage of assembly with the narrow front extension on the bottom panel folded inwardly across the front opening and the wedge-shaped flaps folded downwardly into position along the side panels;

FIG. 5 is a side and back perspective view of the preferred form of the vanity top container illustrated in FIGS. 1–4 showing the top panel folded into the position with its narrow front extension and wedge-shaped flaps folded inwardly for insertion of the end tabs into slots formed adjacent the fold lines between the back and side panels;

FIG. 6 is a partial front perspective view of one side of the fully assembled vanity top container in accordance with the invention as illustrated in FIG. 1–5 showing the interleaving of the top, bottom and side panels and flaps;

FIG. 7 is a front perspective view of the fully assembled vanity top container, as illustrated in FIG. 1–6, supporting and enclosing a typical vanity top assembly;

FIG. 8 is a side plane view of the fully assembled container enclosing a vanity top assembly, as illustrated in FIG. 7, with the covered portions of the enclosed vanity top assembly shown in phantom outline; and, FIG. 9 is a top sectional view of the fully assembled container taken along the lines 9—9 with the position of the enclosed vanity top assembly shown in phantom outline.

DETAILED DESCRIPTION

Referring now to FIG. 1, a vanity top container structure 10, in accordance with the preferred embodiment of the invention, is formed from a single planar rectangular sheet of box material, such as cardboard, corrugated paperboard or stiffened plastic sheeting, by use of a single die having sharp blade edges to make cuts through the sheet material, as illustrated by the solid lines in the drawing, and blunted edges that are pressed into the sheet to form crease or fold lines, as illustrated by the dashed lines in the drawing. With a properly sized rectangular sheet stock, the amount of waste material cut from the edges is kept to a minimum.

The cardboard container structure 10 has a large rectangular shaped back panel 12 surrounded by rectangular left and right side wall panels 14 and 16 and rectangular top and bottom wall panels 18 and 20 that are hinged to be folded inwardly along their respective crease lines 22, 23, 24 and 25 to extend at right angles to the back panel 12, as best illustrated in FIGS. 2 and 3. The left and right side wall panels 14 and 16 both have substantially square upper and lower end flaps 26 and 28, formed at opposite ends with cut lines 30 and 32 intersecting at right angles to separate the sheet material forming the upper and lower flaps 26 and 28 from the sheet material forming the top and bottom wall panels 18 and 20.

An elongated wedge-shaped center flap 34 that extends along the outer edge intermediate the top and bottom edges of each side wall panel 14 and 16 is formed by cut lines that extend inwardly from the outer edge to intersect the opposite ends of a double fold or crease line 36 that allows the wedge-shaped center flaps 34 to fold inwardly, as shown by the directional arrow 37 in FIG. 3, to overlap the adjacent inner surface of each side wall panel 14 and 16. A small rounded tab 38 cut near the middle of each center flap 34 is positioned to overlie a substantially identically shaped rounded tab 40 cut into each side wall panel 14 and 16 so that, when the flap 34 is doubled over onto the inner surface of the side wall panel 14 or 16, both tabs 38 and 40 can be pushed inwardly together as shown in FIGS. 4, 5 and 6, to secure the center flaps 34 in that position. An elongated oval shaped handle slot 42 is cut into both side wall panels 14 and 16 parallel to and displaced a short distance down from the upper edge.

The rectangular bottom wall panel 20 has a narrow lower front extension 44 hinged along a crease line 46 to be folded inwardly at right angles to the bottom wall panel 20. The narrow lower front extension 44 is roughly rectangular but may have a shallow concavely curved center area 48 cut out to increase the viewing area. A wedge-shaped side flap 50 extends out from either end of the narrow lower front extension 44 and is hinged along the crease line 52 to fold inwardly at right angles to the lower front extension 44, as best illustrated in FIG. 4. Rectangular end tabs 54 at the upper end of the side flaps 50 are hinged along fold or crease lines 56 to bend inwardly at right angles for insertion into narrow slots 58 cut into the adjacent side wall panels 14 and 16 alongside the crease lines 22 and 23, respectively, as best illustrated in FIG. 5.

The rectangular top wall panel 18 has a narrow upper front extension 59 hinged along a crease line 60 to be folded inwardly at right angles to the top wall panel 18. A wedge-shaped side flap 62 extends outwardly from and is hinged at either end of the upper front extension 59 to fold inwardly at right angles along crease lines 64. Each side flap 62 has a rectangular tab 66 formed at its outer end that is hinged along a crease line 68 to fold inwardly at right angles for insertion into a narrow upper slot 70 cut into the adjacent side panels 14 and 16 alongside the crease lines 23, as best illustrated in FIG. 5.

In assembling the container 10, the back panel 12 is placed on a level work surface, and both side wall panels 14 and 16 are folded inwardly, as shown by the directional arrow 84 in FIG. 2, to be positioned at right angles to the back panel 12 with the attached upper and lower end flaps 26 and 28 folded inwardly, as shown by the directional arrows 86 in FIG. 2. The center flaps 34 are also folded inwardly along the double fold or crease lines 36 to overlap the inner surface of the respective side wall panel 14 or 16, and the overlapping rounded tabs 38 and 40 are pushed inwardly together to interlock with one another thereby forming a double thickness surface for supporting the undersurface of the product along its side edges.

With the side wall panels 14 and 16 and the attached upper, lower and center flaps 26, 28 and 34 folded into position, the bottom wall panel 20 is folded inwardly, as shown by the directional arrow 88 in FIG. 3, to abut the bottom edges of the side wall panels 14 and 16. In that position, the side flaps 50 at either end of the narrow lower front extension 44 can be folded inwardly so they extend along the lower portion of the respective side wall panels 14 and 16, as shown in FIG. 4, to place the end tabs 54 adjacent the narrow lower slots 58 cut in the adjacent side wall panels 14 and 16 alongside the crease lines 22 and 23 where the side wall panels 14 and 16 are hinged to the back panel 12.

Similarly, the top wall panel 18 is folded inwardly, as shown by the directional arrow 90 in FIG. 4, to contact the top edges of the side wall panels 14 and 16, and the narrow upper front extension 59 is folded over onto the top edges of the side wall panels 14 and 16. The wedge-shaped side flaps 62 at either end are then folded inwardly and downward to position the end tabs 66 for insertion into the narrow upper slots 70 cut in the adjacent side wall panel 14 or 16 alongside the crease lines 22 and 23, as shown by the directional arrow 92 in FIG. 5. Hinged elongated oval shaped tabs 69 register with the oval handle openings 42 in the side wall panels 14 and 16 where they can be pushed inwardly for carrying.

In the preferred form for use with the vanity top assembly configuration 9 as illustrated herein, the outer ends of the upper end flaps 26 attached to the side wall panels 14 and 16 are cut longitudinally along a line 94 that extends at an angle from the outermost edge to intersect an intermediate fold line 95, thus forming a wedge-shaped inner flap section 96 that folds inwardly at right angles to the rest of the flap 26. In this position, the inner flap section 96 on either side makes contact with the undersurface of the vanity top product 9 along a line extending from underneath the splash shield 8 at the back inwardly on either side of the convexly protruding bowl 7 to firmly position the product within the container.

During assembly, the cut and grooved sheet 10 should be laid flat on a level work surface that firmly supports at least the back panel 12. The side wall panels 14 and 16 are then folded upward and inwardly, and their hinged lower end flaps 28 are folded inwardly, as illustrated in FIG. 2, to be mutually perpendicular both to the plane of the back panel 12 and the side wall panels 14 and 16. The center flaps 34 on both side wall panels 14 and 16 are folded inwardly along the double fold or crease line 36, as illustrated by the directional arrow 37 in FIG. 3, to overlap the inner surface so the rounded tabs 38 and 40, which register with one another, can be pushed in together through the surrounding openings to lock the center flap 34 in its folded overlapping position. The upper surface extending along the double fold 36 on both side wall panels 14 and 16, which in this case is sloped, can then support the undersurface at the edges on both sides of a vanity top assembly.

After the side wall panels 14 and 16 with their attached lower end flaps 28 are properly positioned, the bottom wall panel 20 is folded upward and inwardly at right angles to the back panel 12 to abut the lower edges of both side wall panels 14 and 16. The lower front extension 44 is folded over at right angles to the bottom wall panel 20, and the wedge-shaped flaps 50 are folded inwardly where the end tabs 54 can be inserted into the lower slots 58 cut into the side wall panels 14 and 16 adjacent the crease lines 23.

At this point, a stable three sided box structure exists into which the vanity top can be inserted front edge first beneath the narrow lower front extension 44 to position the lower drain extension 5 near the center of back panel 12, as illustrated in FIGS. 8 and 9.

With the vanity top assembly in place, the container 10 can then be closed by first folding the upper end flaps 26 on the side wall panels 14 and 16 inwardly at right angles to abut the back edge of the splash panel 8. The wedge-shaped inner flap sections 96 below the angled longitudinal cuts 94 are then folded inwardly along the crease lines 95, as shown by the directional arrow 97 in FIG. 3, to be at right angles to the rest of the upper end flap 26. The top edges of the wedge-shaped flaps 96 then lie parallel to and coextensive in a common plane with the double fold surfaces in the side wall panels 14 and 16 to thus provide additional inboard support for the substantially planar back undersurface of the vanity top assembly. The top wall panel 18 is then folded inwardly to abut the upper edges of the side wall panels 14 and 16 while pushing the upper end flaps 26 against the top edge of the splash panel 8. The narrow upper front extension 59 hinged on the top wall panel 28 is folded over to cover the adjacent upper edge of the splash panel 8, and the wedge-shaped end flaps 62 at either end are bent downwardly so that the end tabs 66 can be inserted into the corresponding slots 70 cut in the side wall panels 14 and 16, thus completing the assembly.

To permit carrying, the elongated oval handle tabs 69 formed in the wedge-shaped end flaps 62 attached to the upper front extension 59 are pushed inwardly through the corresponding openings 42 in the side wall panels 14 and 16 so the hinged portion at the top of the elongated oval tabs 69 covers the upper edge of the opening 42 to provide a comfortable gripping surface on either side for moving or carrying the heavy vanity top in its container.

The vanity top assembly is thus secured against inward movement within the assembled container 10 along its under surface both at the outer side edges by the doublefold upper surface where the central wedge-shaped flaps 34 are hinged and also by the wedge-shaped inner flap sections 96 on the side wall panel end flaps 26. At the same time, the vanity top assembly firmly restrained against outward movement by the narrow top and bottom front extensions 59 and 44 which leave almost the entire bowl and surrounding top surface open to view for inspection by prospective customer.

The location of the interlocking tabs 54 at the outer upper end of the lower wedge-shaped flaps 50 assists in maintaining the structural integrity of the container assembly 10 by resisting the downward force exerted by the front edge of the vanity top assembly against the outer edge of the bottom wall panel 20. The restraining force is exerted diagonally along the path between the tabs 54 and the ends of the lower front extension 44 to resist both outward movement of the narrow lower front extension 44 and downward movement of the outer edge of the bottom wall panel 20. Also, the diagonal direction of the force exerted on the vertically positioned end tabs 54 increases the frictional contact of the tabs 54 against the inner surfaces of the slots 58 to resist pulling the tabs out of the slots.

Also, the downward force due to the weight of the vanity resting along the front edge of the bottom wall panel is further supported by the lower end flaps 28 attached to the respective side wall panels 14 and 16 so that the downward force is transmitted along the length of the side wall panels 14 and 16 to the handle openings 42. Similarly, the location of the tabs 66 on the upper wedge-shaped end flaps 62 serve to transmit the lifting forces applied to the handle tabs 69 in carrying the container along a diagonal path to impart a twisting force that tends to maintain the end tabs 66 with increased frictional force against the internal surfaces of the upper slots 70 to resist their pulling free.

The invention has been described herein in connection with a preferred embodiment intended for use with composite marble vanity tops assemblies of the particular style and configuration illustrated, but it should be appreciated by those skilled in the art that various changes may be made in the particular configuration and shape of the different segments to accommodate other vanity top designs and similar products without departing from the overall spirit and scope of the invention as set forth in the appended claims.

What is claimed is:

1. A container for displaying and transporting a heavy product, comprising:

a planar, substantially rectangular back panel with top, bottom and opposing side edges;

a pair of substantially rectangular side wall panels hinged at inner edges of said side wall panels along the opposing side edges of said back panel, said side wall panels folded inwardly to a position substantially at right angles to the plane of said back panel;

each of said side wall panels having a substantially rectangular upper end flap hinged along an upper edge of said side wall panel, said upper end flap folded inwardly at least in part at a right angle to said side wall panel such that said upper end flap overlies an inner surface of said top wall panel;

each of said substantially rectangular upper end flaps having a wedge-shaped inner section cut therein and hinged, said inner section folded inwardly at a right angle to the remainder of said upper end flap such that said inner section supports an underside surface of the product;

a substantially rectangular top wall panel hinged at an inner edge of said top wall panel along the top edge of said back panel, said top wall panel folded inwardly to extend at substantially right angles to the plane of said back panel such that said top wall panel abuts said opposing side wall panels;

a substantially rectangular bottom wall panel hinged at an inner edge of said bottom wall panel along the bottom edge of said back panel, said bottom wall panel folded inwardly to extend at substantially right angles to the plane of said back panel such that said bottom wall panel abuts the bottom edges of said opposing side wall panels;

a narrow substantially rectangular lower front extension hinged along the outer edge of said bottom wall panel;

a narrow substantially rectangular upper front extension hinged along the outer edge of said top wall panel; and said upper and lower front extensions hinged and folded inwardly at right angles to their respective top and bottom wall panels, each of said upper and lower front extensions having a side flap secured at each end of said extension in interlocking engagement with said adjacent side wall panel.

2. The container as defined in claim 1, wherein:

each of said opposing side wall panels has a substantially rectangular lower end flap hinged along a bottom edge of said side wall panel, said lower end flap folded inwardly at right angles to said side wall panel such that said lower end flap overlies an adjacent inner surface of said bottom wall panel; and each of said side wall panels has an elongated central flap section formed along an outer edge of said side wall panel, intermediate to top and bottom edges of said side wall panel, said central flap section hinged and folded inwardly to overlie an adjacent inner surface of said side wall panel thereby providing a double fold surface for supporting opposite an underside edge of the product.

3. The container as defined in claim 1 or claim 2, wherein:

said back, side wall, and top and bottom wall panels and said upper and lower front extensions are formed integrally from a substantially rectangular planar sheet of stiffened packing material.

4. The container as defined in claim 1, wherein:

said side flaps hinged at the ends of said upper and lower narrow front extensions are each wedge-shaped with an interlocking tab hinged at an outermost end engaging a slot formed in the adjacent side wall panel alongside the side edge of said back panel.

5. The container as defined in claim 1, wherein:

each of said opposing side wall panels has a substantially rectangular lower end flap hinged along a bottom edge of said side wall panel, said lower end flap folded inwardly at a right angle to said side wall panel such that said lower end flap overlies an inner surface of said bottom panel.

6. The container as defined in claim 5, wherein:

said back, side, top and bottom wall panels, said upper and lower front extensions, and said upper and lower flaps hinged along each of said side wall panels are formed integrally from a substantially rectangular planar sheet of stiffened packing material.

7. The container as defined in claim 2, further comprising:

lock structure for releasably maintaining each of said central flap sections in overlying adjacent relation relative to its respective side wall panel.

8. The container as defined in claim 1, further comprising:

handle structure integrally formed with and provided on each of said side wall panels for facilitating transportation of the container.

9. A container for transporting a product, comprising:

a back panel with top, bottom and opposing side edges;

a pair of side wall panels hinged at inner edges of said side wall panels along the opposing side edges of said back panel, said side wall panels folded inwardly relative to said back panel;

each side wall panel having an elongated central flap formed and hinged along an outer edge of said side wall panel, said central flap folded such that said central flap provides a double fold surface for supporting the product, wherein each of said side wall panels has a locking tab adapted to interlock with said adjacent central flap for releasably maintaining said central flap folded relative to an inner surface of said side wall panel;

a top wall panel hinged at an inner edge of said top wall panel along the top edge of said back panel, said top wall panel folded inwardly relative to said back panel; such that said top wall panel abuts said opposing side wall panels;

a bottom wall panel hinged at an inner edge of said bottom wall panel along the bottom edge of said back panel, said bottom wall panel folded inwardly relative to said back panel such that said bottom wall panel abuts said opposing side wall panels;

a lower front extension hinged along an outer edge of said bottom wall panel, said lower front extension folded and extended toward said top wall panel;

an upper front extension hinged along an outer edge of said top wall panel, said upper front extension folded and extended toward said bottom wall panel; and said upper and lower front extensions each having a side flap secured at each end of said extension in an interlocking relationship with the adjacent side wall panel.

10. The container as defined in claim 9, wherein said lower and said upper front extensions extend toward each other for less than one-half a distance of separation of said top and bottom wall panels.

11. The container as defined in claim 9, wherein each of said upper and lower front extensions has a relatively narrow configuration in the direction of separation between said top and bottom wall panels for enhancing visibility of the product enclosed by the container.

12. The container as defined in claim 9, wherein said lower and upper front extensions extend generally coplanar relative to each other and generally parallel to said back panel.

13. The container as defined in claim 9, wherein each of said side wall panel and adjacent central flap pairs has an interlocking tab and opening which coact for securing said side wall panel and said central flap to each other.

14. A container for transporting a heavy product having topside and underside surfaces, said container comprising:

a paperboard blank scored and cut longitudinally and transversely and folded to define a back panel, a pair of side wall panels, and top and bottom wall panels having upper and lower front extensions, respectively, to enclose the product therein in a slanted orientation an such that the product is substantially restrained from movement within the container, with the folded side wall panels defining a slanted substantially planar generally front-facing surface to engage and support a surface of the product in its slanted orientation, and wherein said upper and lower front extensions each have side flaps extending from opposite ends with tabs at outer ends of said side flaps, said tabs being adapted to interlock with an opening formed in each of said adjacent side wall panels at predetermined locations to resist outward movement of the upper and lower front extensions and downward movement of the bottom wall panel thus providing strength and rigidity to the container.

15. The container as defined in claim 14, wherein said upper and lower front extensions, when folded, are arranged generally coplanar relative to one another, extending toward one another and leaving substantial space between one another to promote visual display of the product enclosed within the container.

16. A container for transporting a product, having a top, a bottom, a pair of sides, a back and a front, comprising:

a back panel with top, bottom and opposing side edges;

a pair of side wall panels hinged at inner edges of said side wall panels along said opposing side edges of said back panel, said side wall panels folded relative to said back panel such that said side wall panels close the sides of the container;

a lower front panel spaced from and extending generally parallel to said back panel and between said side wall panels;

an upper front panel spaced from and extending generally parallel to said back panel and between said side wall panels, said lower front panel and said upper front panel extending generally coplanar relative to each other;

a top wall panel hingedly connected to said upper front panel, said top wall panel folded such that said top wall panel closes the top of the container between said upper front panel and said back panel;

a bottom wall panel hingedly connected to said lower front panel, said bottom wall panel folded such that said bottom wall panel closes the bottom of the container between said lower front panel and said back panel;

each of said side wall panels having an elongated central flap formed along an outer edge of said side wall panel, said central flap hinged and folded along said hinge in overlying relationship to said side wall panel to define a slanted front surface of the container; and each of said side wall panels further having an end flap hinged to an upper edge of said side wall panel, said end flap at least in part folded inwardly in spaced generally parallel relation to said side wall panel, defining a surface extending generally transverse to said top and bottom wall panels to block movement of the product enclosed within the container toward said back panel.

17. The container as defined in claim 16, further comprising:

a handle structure integrally formed with and provided on each of said side wall panels for facilitating transportation of the container.

18. A container for displaying and transporting a heavy product in a slanted orientation, comprising:

a planar, substantially rectangular back panel with top, bottom and opposing side edges;

a pair of substantially rectangular side wall panels hinged at inner edges of said side wall panels along the opposing side edges of said back panel, said side wall panels folded inwardly to a position substantially at right angles to the plane of said back panel;

a substantially rectangular top wall panel hinged at an inner edge of said top wall panel along the top edge of said back panel, said top wall panel folded inwardly to extend at substantially right angles to the plane of said back panel such that said top wall panel abuts said opposing side wall panels;

a substantially rectangular bottom wall panel hinged at an inner edge of said bottom wall panel along the bottom edge of said back panel, said bottom wall panel folded inwardly to extend at substantially right angles to the plane of said back panel such that said bottom wall panel abuts the bottom edges of said opposing side wall panels;

a narrow substantially rectangular lower front extension hinged along the outer edge of said bottom wall panel;

a narrow substantially rectangular upper front extension hinged along the outer edge of said top wall panel;

said upper and lower front extensions hinged and folded inwardly at right angles to their respective top and bottom wall panels, each of said upper and lower front extensions having a side flap secured at each end of said extension in interlocking engagement with said adjacent side wall panel; and each of said side wall panels having an elongated central flap section formed along an outer edge of said side wall panel, intermediate to top and bottom edges of said side wall panel, said central flap section hinged and folded inwardly to define a generally front-facing, double fold front surface for the container slanted in a front and back direction and elongated in a direction generally transverse to said top and bottom wall panels for supporting the product in a slanted orientation opposite an elongated underside edge of the product.

19. The container as defined in claim 18, wherein:

each of said opposing side wall panels has an upper end flap hinged along an upper edge of said side wall panel, said end flap at least in part folded inwardly in spaced generally parallel relation to said side wall panel, defining a surface extending generally transverse to said top and bottom wall panels to block movement of the product toward said back panel.

20. A container for transporting a product, comprising:

a back panel with top, bottom and opposing side edges;

a pair of side wall panels hinged at inner edges of said side wall panels along the opposing side edges of said back panel, said side wall panels folded inwardly relative to said back panel;

each side wall panel having a flap formed and hinged along an outer edge of said side wall panel, said flap folded such that said flap provides a generally front-facing, double fold front surface for the container slanted in a front and back direction and elongated in a direction generally transverse to said top and bottom wall panels;

a top wall panel hinged at an inner edge of said top wall panel along the top edge of said back panel, said top wall panel folded inwardly relative to said back panel such that said top wall panel abuts said opposing side wall panels;

a bottom wall panel hinged at an inner edge of said bottom wall panel along the bottom edge of said back panel, said bottom wall panel folded inwardly relative to said back panel such that said bottom wall panel abuts said opposing side wall panels;

a lower front extension hinged along an outer edge of said bottom wall panel, said lower front extension folded and extended toward said top wall panel;

an upper front extension hinged along an outer edge of said top wall panel, said upper front extension folded and extended toward said bottom wall panel; and said upper and lower front extensions each having a side flap secured at each end of said extension in an interlocking relationship with the adjacent side wall panel.

21. The container as defined in claim 20, wherein:

each of said side wall panels has an upper end flap hinged along an upper edge of said side wall panel, said end flap at least in part folded inwardly in spaced generally parallel relation to said side wall panel, defining a surface extending generally transverse to said top and bottom wall panels to block movement of the product toward said back panel.

22. A container for transporting a product, having a top, a bottom, a pair of sides, a back and a front, comprising:

a back panel with top, bottom and opposing side edges;

a pair of side wall panels hinged at inner edges of said side wall panels along said opposing side edges of said back panel, said side wall panels folded relative to said back panel such that said side wall panels close the sides of the container;

a lower front panel spaced from and extending generally parallel to said back panel and between said side wall panels;

an upper front panel spaced from and extending generally parallel to said back panel and between said side wall panels, said lower front panel and said upper front panel extending generally coplanar relative to each other;

a top wall panel hingedly connected to said upper front panel, said top wall panel folded such that said top wall panel closes the top of the container between said upper front panel and said back panel;

a bottom wall panel hingedly connected to said lower front panel, said bottom wall panel folded such that said bottom wall panel closes the bottom of the container between said lower front panel and said back panel; and each of said side wall panels having a flap formed along an outer edge of said side wall panel, said flap hinged and folded along said hinge in overlying relationship to said side wall panel to define a generally front-facing, double fold front surface for the container slanted in a front and back direction and elongated in a direction generally transverse to said top and bottom wall panels.

23. The container as defined in claim 22, further comprising:

a handle structure integrally formed with and provided on each of said side wall panels for facilitating transportation of the container.

* * * * *

UNITED STATES PATENT AND TRADEMARK OFFICE

CERTIFICATE OF CORRECTION

PATENT NO. : 5,322,212

DATED : June 21, 1994

INVENTOR(S) : Strasevicz et al.

It is certified that error appears in the above-indentified patent and that said Letters Patent is hereby corrected as shown below:

Title page, item [75], change "Shoultz" to --Shoults--.

Signed and Sealed this

Twenty-fifth Day of October, 1994

*Attest:*

*Attesting Officer*

BRUCE LEHMAN

*Commissioner of Patents and Trademarks*